United States Patent [19]

Carpenter et al.

[11] 4,206,024

[45] Jun. 3, 1980

[54] ELECTROCHEMICAL LEACHING METHODS

[75] Inventors: Neil L. Carpenter, Kerrville, Tex.; Clark Goodman, Coronado, Calif.

[73] Assignees: Darrell G. Lochte, Kerrville; Henry J. Gruy, Houston; Thomas C. Syfan, Mountain Home; Darryl M. Springs; Edmund F. Bard, both of Houston, all of Tex.

[21] Appl. No.: 873,808

[22] Filed: Jan. 31, 1978

Related U.S. Application Data

[62] Division of Ser. No. 544,413, Jan. 27, 1975, Pat. No. 4,071,278.

[51] Int. Cl.[2] ..... C25B 1/00; C25C 1/00

[52] U.S. Cl. ..... 204/130

[58] Field of Search ..... 204/105 R, 130, 107, 204/108

[56] References Cited

U.S. PATENT DOCUMENTS

| | | | |
|---|---|---|---|
| 2,761,829 | 9/1956 | Dolloff | 204/106 |
| 3,957,601 | 5/1976 | Drinkard et al. | 204/105 R |

*Primary Examiner*—R. L. Andrews

*Attorney, Agent, or Firm*—Darryl M. Springs

[57] ABSTRACT

In a leaching process to recover a selected element or mineral from a gangue, an AC current is applied to the mixture to accelerate the rate at which chemical reactions occur. If the treated material is located in a subsurface earth formation, the AC current may further generate gases in situ to assist in moving and circulating the leaching solution in the formation and to bring the dissolved mineral value to the surface through a borehole or the like. This acceleration of the chemical reactions can shorten the effective leaching time from weeks or months to a matter of hours or days, thereby greatly affecting the rate of recovery of the mineral value and making such leach mining economical on a commercial basis.

6 Claims, 18 Drawing Figures

316
317
318
319
LEACHING SOLUTION
334
337
336
338
314
315
312
324
326
329
330
331
340
328
POWER SUPPLY

TO TREATMENT PLANT
319
318
317
316
321
315
312
324
326
331
329
328
330
POWER SUPPLY
314

ELECTROCHEMICAL LEACHING METHODS

This is a division of application Ser. No. 544,413, filed Jan. 27, 1975, now U.S. Pat. No. 4,071,278.

BACKGROUND OF INVENTION

This invention relates to methods and apparatus for recovering minerals and the like from both surface and subsurface deposits and more particularly relates to improved leaching methods and apparatus for recovering such minerals.

It is well known to employ conventional shaft and stripmining techniques to recover ores containing valuable metals and other elements, and it is also well known to employ conventional reduction processes to isolate and recover these elements from the ores obtained by such mining techniques. It is further well known that most strip mining has a damaging environmental effect on the surrounding area. Shaft mining also damages the surrounding area, and has the further disadvantage of being hazardous and expensive. On the other hand, there has heretofore been no other way to recover these metals and elements which are essential to our modern industrial society, and thus mining operations have for the most part been tolerated by society as necessary and unavoidable.

A further problem arises from the fact that the ores sought to be recovered are usually physically intermingled with other unwanted material (gangue) and thus conventional excavation techniques will necessarily produce a substantial amount of this unwanted material along with the ores sought to be recovered. Conventional reduction techniques will separate a substantial proportion of the ores sought to be recovered, of course, but a proportion will usually remain in the "tailings" which inherently accumulate at or about the mine site.

It has long been recognized that, although these valuable materials may constitute only a relatively small proportion of these tailings, the very fact that the tailings tend to be accumulated in enormous quantities over a period of time means that a substantial amount of valuable material has also been accumulated. Furthermore, such tailings often contain other valuable minerals and elements besides, which were by-passed during the extraction and reduction operations.

It is conventional to treat an accumulation of mine tailings with a leaching solution for the purpose of using oxidation-reduction reactions for separating and recovering a particular element or mineral from the unwanted material or gangue which constitutes the major portion of such tailings. In particular, the leaching solution is poured onto the tailings either continuously or intermittently, whereby the solution tends to seep down into and percolate through the heap until it reaches an impermeable level, whereupon it exits the heap carrying one or more valuable elements in solution. It will be apparent, of course, that the leaching solution chosen for this purpose must be such that it dissolves only the mineral of interest, and not the gangue in which the mineral is found.

Conventional leaching techniques have sometimes been so successful from a commercial standpoint that it has been proposed to employ leaching to recover ores from subsurface deposits as well. In other words, the leaching solution would be injected into the formation by means of boreholes, and would thereafter be withdrawn from the formation through the same or other boreholes after dissolving part or all of the material sought to be recovered. Leaching has not yet proved to be a suitable substitute for conventional mining operations, except under unusual circumstances, partly because of problems involved in effectively withdrawing the leaching solution from the formation, but principally because of the inherently slow rate at which chemical reactions occur when a leaching solution is used to dissolve the mineral of interest.

The rate at which the mineral value of interest tends to be dissolved in a suitable leaching solution is relatively quite slow. It often negates the use of leaching techniques for recovering mineral values from both subsurface deposits and mine tailings.

These disadvantages of the prior art are overcome with the present invention, however, and novel methods and apparatus are provided for enhancing the rate at which a selected ore or other mineral is dissolved in a leaching solution.

PRINCIPLE OF INVENTION

The theory and operation of the present invention will later be discussed in detail. In principle, however, the present invention involves the application of an electric current to accelerate the rate at which chemical reactions occur in the leaching process.

The invention can best be appreciated, therefore, if based on an understanding of the leaching process per se. It is well known, for example, that uranium occurs in the form of the mixed oxides known commonly as uraninite or carnotite, and that these oxides, $UO_3$ and $UO_2$, are insoluble in water. When $UO_2$ is converted to the uranyl form ($UO_2^{++}$), however, it will combine with chlorine to produce $UO_2Cl_2$ which is quite soluble.

In this particular instance, the appropriate leaching material is a ferric chloride solution, whereby the following reaction occurs:

$$UO_2+2FeCl_3 \rightarrow UO_2Cl_2+2FeCl_2$$

The ferric chloride solution is pumped into the subsurface ore formation, or applied to a pile of tailings, for recovering a solution of $UO_2Cl_2$. In either case, the leaching solution is brought into physical contact with the uranium oxide. Some of the uranium atoms at the interface of the leaching solution and the uranium ore will experience an increase in valence to produce the uranyl radical, and it is these radicals which combine with the chlorine ions in the ferric chloride solution to produce uranyl chloride by an oxidation-reduction reaction.

Each combination of a chlorine ion with a uranyl radical is, of course, a separate interaction caused by the chlorine ion moving in the solution to bombard the uranyl radical at the interface. It will be apparent that whether a particular uranyl radical will be struck by a chlorine ion is a matter of probability which depends upon the bombardment rate of the chlorine ions at the interface. If the leaching solution is subjected to a flow of electric current, the chlorine ions in the leaching solution become greatly excited and this, in turn, accelerates the rate of bombardment of chlorine ions at the interface. This, in turn, greatly accelerates the rate at which the chlorine ions combine with uranyl radicals to produce the $UO_2Cl_2$ sought to be recovered.

The ultimate amount of $UO_2Cl_2$ to be produced by the leaching process depends, of course, on the total amount of uranium ore available, and thus the present invention cannot (in theory) increase the ultimate total amount of uranium to be obtained. What the invention can do, however, is to produce at least the same amount of uranium within a fraction of the time required with the use of conventional leaching techniques.

Actually, the total recoverable amount of uranium or other valuable material is greater with the use of the present invention, simply because excitement of the chlorine ions will increase the probability that a greater number of uranyl radicals will be contacted by the chlorine ions, as well as the fact that the same number will be struck during a shorter time interval. In addition, the electric potential created in the mixture of gangue and uranium oxide tends to increase the overall number of uranyl radicals which are available to be targets for the bombarding chlorine ions.

SUMMARY OF INVENTION

The particular leaching solution to be used will, of course, depend upon the mineral or other material sought to be treated. In summary, therefore, the present invention comprises the application of an electric current to a selected mineral in contact with a suitable leaching solution to accelerate the rate at which a particular chemical reaction will occur. Any type of current may be used for this purpose, although it is particularly useful to employ either AC or pulsed DC current. In addition, the material to be subjected to this current may be either tailings located at the surface of the earth, either in a stationary heap or in a moving treatment system, or the subject material may be ores and other mineral-bearing earth substances located in their natural state in surface or subsurface deposits.

There is set forth in the copending U.S. patent application filed by Neil L. Carpenter on Apr. 19, 1974, and having Ser. No. 462,326, now abandoned, a technique for the recovery of petroleum substances from subsurface earth formations tapped by boreholes, wherein the formation pressure is enhanced by applying an AC current thereacross to generate gas in situ. Accordingly, the application of an AC current to a subsurface mineral-bearing formation may have a further advantage, when a leaching solution is employed in the formation, since any gas generated may be used to more effectively move and circulate the leaching solution in the formation and bring the dissolved mineral value to the surface through a borehole. In addition, the application of an AC current to an electrolytic leaching solution generates heat, and this, in turn, further increases the rate at which the chemical reactions will occur in a particular system.

BRIEF DESCRIPTION OF THE DRAWINGS

In order that the manner in which the above-recited advantages and features of the invention are attained can be understood in detail, a more particular description of the invention may be had by reference to specific embodiments thereof which are illustrated in the appended drawings, which drawings form a part of this specification. It is to be noted, however, that the appended drawings illustrate only typical embodiments of the invention and therefore are not to be considered limiting of its scope for the invention may admit to further equally effective embodiments.

In the drawings.

DETAILED DESCRIPTION OF THE PREFERRED EMBODIMENTS

Figure 1:
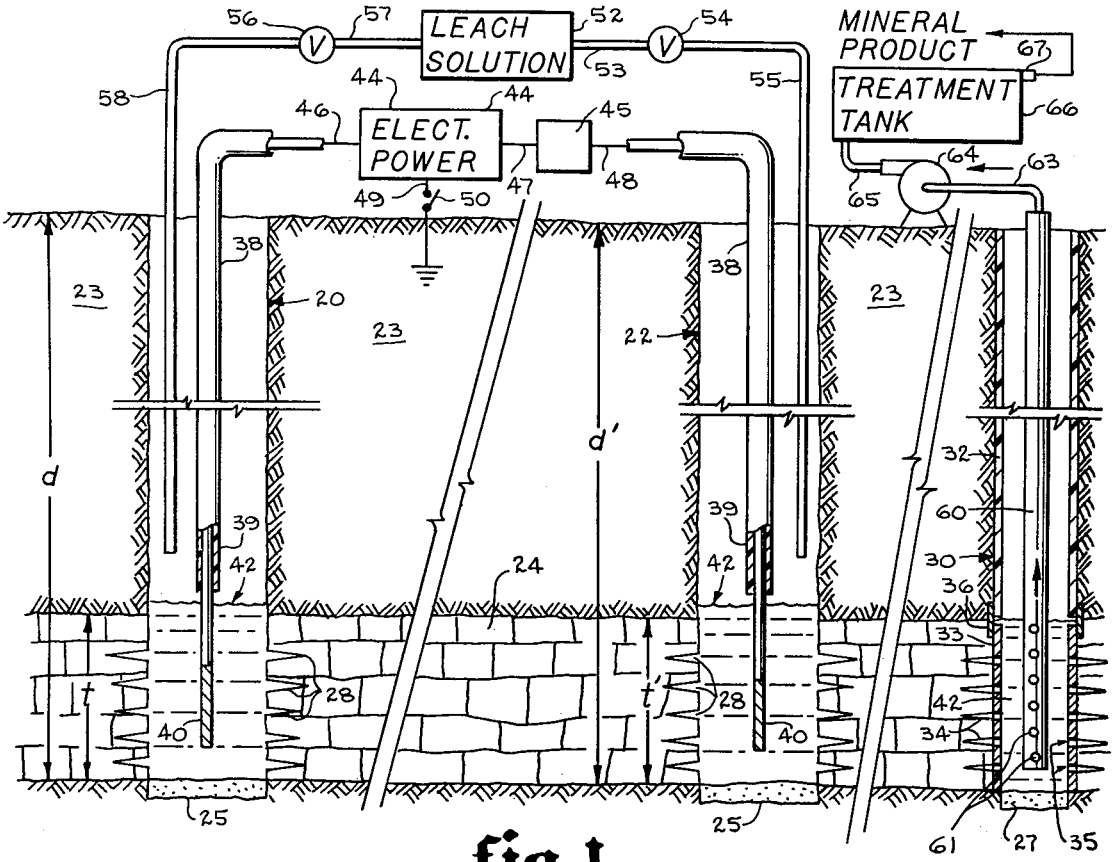
FIG. 1 is a cross-sectional view of a subsurface mineral-bearing formation penetrated by a pair of boreholes for injecting leaching solution into contact with the mineral-bearing formation and equipped to pass an electric current across the formation for recovering selected soluble substances from the formation through another borehole.

Solution mining or "in situ" mining has become of increasing importance over the past few years. The operations generally include removing a mineral value by drilling into the ore body, circulating an extractive solution and removing the mineral value, and separating the mineral value from the solution. Such "in situ" mining utilizes a leaching process where the leaching solution is selected to chemically react with the desired mineral value to dissolve the mineral value from the ore gangue. Such chemical reactions generally include oxidation-reduction reactions, de-adsorptions, and ion exchange reactions to leach the desired mineral value from the ore gangue.

Solution mining or "in situ" leach mining is in its infancy, and much research and development is presently being conducted to find the answers to many technological problems. Leach mining offers many attractive possibilities in improving the environmental impact of mining as well as making feasible the extraction of deeper, low value mineral reserves as well as recovering additional mineral values from mining tailings and other materials not now generally amenable to treatment to recover valuable minerals. However, the economics of such leach mining have presented problems since it often takes weeks or months to extract mineral values in commercial quantities.

An important application of this leach mining process of recovering subsurface mineral values could be applied for the recovery of uranium, which occurs as the oxides uraninite or carnotite in many areas of the world, including Colorado, Utah and New Mexico, as examples.

These oxides $UO_3$ and $UO_2$ are insoluble in water. However, when converted to the uranyl form ($UO_2^{++}$), there are several soluble compounds including uranyl chloride ($UO_2Cl_2$). This transformation can take place in the presence of ferric chloride ($FeCl_3$) since uranous ions are oxidized by the ferric reduction to ferrous chloride ($FeCl_2$). Hydrochloric acid (HCl) may be added to provide a desirable pH and to act as a source of additional chlorine ions. Thus $$UO_2+FeCl_3+HCl \rightarrow UO_2Cl_2+2FeCl_2+HCl \quad (1)$$

This reaction can be used to leach insoluble uranium ores out of subsurface formations by pumping ferric chloride solutions into the uranium ores, leaching out the uranyl form of the uranium oxides, and pumping to the surface the dissolved $UO_2Cl_2$ for conventional processing to extract the uranium. Of course, many mineral values may be extracted by proper selection of the leaching solution to dissolve some soluble form of the mineral.

It has been discovered that passing an electric current through these subsurface ore formations with the leaching solution present accelerates the leaching process in different ways:

(1) by dramatically increasing the ion activity of the leaching solution, causing the leaching solution ions to increasingly interact with the atoms of the mineral value, thereby accelerating chemical reactions; and (2) by heating the leaching solution and the mineral value in the ore, thereby increasing the rate of the reactions.

This acceleration of the chemical reactions can shorten the effective leaching time from weeks or months to a matter of hours or days, thereby greatly affecting the rate of recovery of the mineral value and making such leach mining economical on a commercial basis.

In addition, the use of an electric current can also provide a pressure drive, generated by steam or evolved gases, to force the leaching solution through the ore formation to effect greater distribution of the leaching solution and hence greater recovery.

The laws of chemical thermodynamics determine whether a chemical reaction can occur. However, chemical thermodynamics cannot determine that a chemical reaction will take place in any reasonable period of time. That is, chemical thermodynamics does not establish the rate at which a reaction will occur. The rate and the mechanisms of chemical reactions are the concerns of chemical kinetics. The rate for an elementary reaction is simply proportional to the product of the concentration of the reactants, say A and B:

$$\text{rate}=k(A)(B)$$

Such elementary reactions occur in single collisions of the reactants. This does not imply that all collisions lead to a reaction. Generally only a small fraction of such collisions lead to reaction products, but when the reaction does occur it results from one of these collisions. Most chemical reactions, however, are not elementary but proceed by complex mechanisms involving several elementary reaction steps accompanied by the breakage and formation of several chemical bonds. Even the reaction of $H_2$ and $O_2$ to form $H_2O$ consists of several elementary reaction steps:

$$H_2 \rightarrow 2H\cdot$$

$$H\cdot+O_2 \rightarrow \cdot OH+O\cdot$$

$$O\cdot+H_2 \rightarrow \cdot OH+H\cdot$$

$$H\cdot+O_2+M \rightarrow HO_2\cdot+M$$

$$HO_2\cdot+H_2 \rightarrow H_2O+\cdot OH$$

$$\cdot OH+H_2 \rightarrow H_2O+H\cdot$$

$H_2$ and $O_2$ will not react unless the reaction is started by a flame, spark, a catalysis or by high temperature. If the reaction is carried out in a vessel, the radicals $H\cdot$, $\cdot OH$, and $HO_2\cdot$ can be removed from the chain reaction by reaction at the surface of the container. The M in these reactions is any molecular species that is involved in the collision but does not react itself. The function of M is to remove the energy that is released when a bond is formed. The rates of most reactions increase with increase in temperature. The increase is the result of an increase in the rate constant k with increasing temperature given by the equation:

$$k==Ae^{-(E/Rt)} \quad (2)$$

where:

E is the activation energy,

R is the gas constant,

A is the frequency factor, and

T is temperature.

For an elementary reaction, E can be understood in terms of the increase in internal energy required to form an activated molecular complex. For a multistep reaction, such as that for the formation of $H_2O$, there is no simple explanation for the meaning of E.

We see that k, and hence the rate of the reaction, can be increased in one of several ways: by increasing the frequency factor A, by decreasing the activation energy E or by increasing the temperature T. In the instant invention, all three can take place in some instances. The joulean heating in the solution or in the ore or in both raises the temperature, thereby increasing k. The alternating electric current can also increase the frequency of bombardment of the atoms or radicals and thereby increase k. In some reactions, particularly the oxidation-reduction reactions, the flow of electric current can decrease the activation energy E, thereby increasing k since the negative exponent is decreased. Thus, a theoretical chemical thermodynamic explanation can be offered for the acceleration of the leaching process by the passage of an electric current.

The hereinafter described apparatus and proceses will often be described in connection with the leach mining of uranium. However, this is only given by way of specific example, and it is understood that any mineral value amenable to leach mining is included within the scope of this invention.

Referring now to FIG. 1, one simplified embodiment of the present invention is depicted. A pair of conventional boreholes 20 and 22 are shown drilled into the earth for penetrating overlying strata 23 and a uranium ore deposit 24, such as uraninite, to a depth "d." The thickness of the uraninite ore deposit is shown by "t." The lower end of the boreholes 20 and 22 are sealed by a conventional plug 25. The borehole communicates with the uraninite formation 24 by means of perforations 28 extending into the ore formation. An insulated electrode 38 is disposed in each borehole 20 and 22, with the metal electrode portion 40 extending into the portion of the borehole penetrating the ore formation 24. Insulation 39 can terminate above the top level of the ore formation 24 if desired. The electrodes 38 are connected by conductors 46 and 48 to a source of electrical power 44 and a power control means 45, respectively, interconnected by a conductor 47. The electrical power source 44 is also connected to ground through conductor 49 and switch 50.

A suitable leach solution, such as $FeCl_3$ and HCl, as hereinabove described, is contained in tank 52 and distributed to each borehole 20 and 22 by piping 57 and 58 and valve 56, and piping 53 and 55 and valve 54, respectively, to provide leach solution 42 in the borehole to a depth slightly in excess of the thickness "t" of the formation 24. Another boreholes 30 is provided that is conventionally lined with an insulated casing 32 through the overburden 23 and lined in the ore formation 24 with a non-corrosive metal casing 33 set on a conventional plug 27. The metal casing 33 is joined to the insulated casing 32 by means of a conventional collar 36. Apertures 35 in the metal casing section 33 are provided in conjunction with perforations 34 into the formation 24 to allow the leaching solution to communicate with the interior of borehole 30. A tubing string 60 is disposed in borehole 30 and has perforations 61 to admit leach solution 42. Tubing 60 is connected to a conventional borehole pump 64 by piping 63 for withdrawing the leach solution 42 from the borehole 30. The leach solution is pumped through piping 65 to a conventional treatment tank 66 where the desired uranium oxide compound or other uranium extract is separated and discharged through piping 67 for collection and processing.

In operation, the leaching solution 42 is disposed in boreholes 20 and 22 to a depth sufficient to cover the thickness "t" of the ore formation 24. The leaching solution (ferric chloride, $FeCl_3$ and hydrochloric acid, HCl) will chemically react with the $UO_3$ and $UO_2$ of the uraninite ore 24 according to equation (1) hereinabove described. With switch 50 closed, electric current is passed between electrode 40 and ore formation 24 by the leach solution acting as an electrolyte, with the earth serving as the return electrical conductor. The chemical reaction (in this example, an oxidation-reduction reaction) between the leach solution 42 and ore 24 will be markedly accelerated by the electric current flowing across the interface between solution 42 and ore 24. This increase in chemical reactivity results from both the induced ionic interaction between the ions of the leach solution chemical elements interacting with greater frequency with the atoms of the uranous compound in ore 24, and the accelerated chemical activity resulting from the local heat generated by the passage of the electric current. For some mineral-leach solution combinations, direct current may be found most desirable, while for other applications, alternating current may be more effective. In some cases, a current comprising AC superimposed on a DC may be found desirable.

As the depth of the leaching solution 42 decreases in boreholes 20 and 22, as may be indicated on the surface by a decrease in the current delivered by generator 44, fresh leaching solution is introduced into boreholes 20 and 22 through tubings 57 and 58 and valve 56, and through tubings 53 and 55 and valve 54, respectively, from mixing tank 52 on the surface. The rate of penetration of the conducting leach solution 42 into the surrounding ore formation 24 from a borehole 20 depends on the porosity and permeability of the ore 24, the chemical reactivity of the ore-leach solution mixture and the electric power passed through the ore formation. Depending on a complex combination of these factors, the leaching solution will spread radially over some given period of time until it forms a contiguous zone with another radially spreading leach zone of an adjacent borehole 22. Once the contiguous zone has been bridged between adjacent spaced boreholes, switch 50 may be opened, and electrical current is isolated in the ore formation 24 and flows from electrode to electrode, thereby increasing the electrical efficiency of the process.

At some point, when sufficient leaching solution has permeated the formation 24 and sufficient amounts of uranium oxide have been leached from ore 24 and are present in the leach solution 42, the leach solution 42 may be withdrawn from the formation 24 by conventional techniques, such as pumping through a tubing string 60 penetrating ore formation 24 in a borehole 30, hereinbefore previously described. The leach solution 42 is pumped to treatment or processing equipment 66 where the desired uranium compounds are separated for commercial use utilizing conventional chemical separation or refining processes. The leaching-recovery process is continued until the uranium oxide is leached out to such an extent that the residual concentration has been reduced to such a level that it is no longer economic to continue the process. Of course, in the process above described, the leach solution, after the desired mineral value has been extracted, may be recirculated for use in the boreholes.

Figure 2:
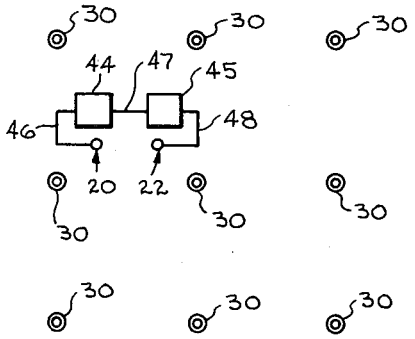
FIG. 2 is a diagrammatic view showing one relationship between leach solution injection and electrode boreholes and production boreholes for solution mining according to one embodiment of the invention.

One arrangement of electrode and leach solution injection boreholes 20 and 22, disposed in a field of spaced producing boreholes 30 is shown in FIG. 2. Such an arrangement may be ideally suited to direct current or single-phase alternating current applications. Another arrangement of electrode and leach solution injection boreholes 70, 71 and 72 are shown spaced in a triangular pattern, with three-phase alternating current power supplied by a power source 79, regulated by a regulator control 78 interconnected to boreholes 70, 71 and 72 by conductors 74, 75, and 76, respectively, in FIG. 3.

Figure 4:
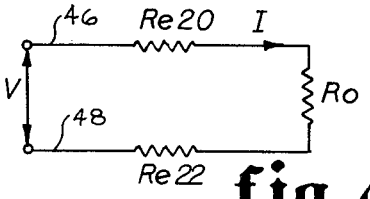
FIG. 4 schematically illustrates the equivalent electrical circuit for the disposition of electrode wells shown in the embodiment of FIG. 2.

FIG. 4 is a schematic representation of an equivalent electrical circuit for a two-well installation shown in FIG. 2. When the source of electrical power 44 is connected between conductors 46 and 48 and electrodes 38 of boreholes 20 and 22 (see also FIG. 1), current will flow through a series path comprising conductor 46, the resistance of the electrode 38 of borehole 20, designated $R_{e20}$, the resistance of the mineral bearing ore formation 24 and the leaching solution, designated $R_o$, the resistance of the electrode 38 of borehole 22, designated $R_{e22}$, and conductor 48, as shown in FIG. 4. The current flowing in this circuit can be expressed mathematically as:

$$I = \frac{V}{R_{e20} + R_{e22} + R_o} \tag{3}$$

and the power dissipated in the formation will, of course, be equal to $I^2R_o$.

Figure 3:
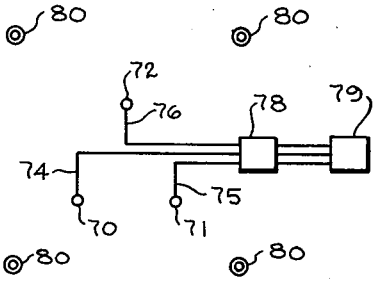
FIG. 3 is a diagrammatic view showing a second relationship between leach solution injection and electrode boreholes and production boreholes for solution mining according to one embodiment of the invention.
Figure 5:
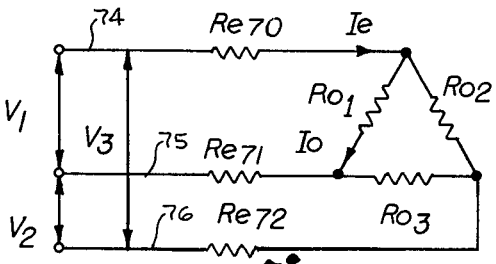
FIG. 5 schematically illustrates the equivalent electrical circuit for the disposition of electrode wells shown in the embodiment of FIG. 3.

In discussing a three-well, three-phase AC installation, as described in FIG. 3, a simplified circuit schematic of of the system can be represented as shown in FIG. 5. With a three-phase AC source 79 connected to electrodes 70, 71 and 72 by conductors 74, 75 and 76, current $I_e$ will flow through conductor 74, electrode 70, represented by resistor $R_{e70}$, through one leg of an assumed "delta" load comprising the conductive substances of ore formation 24 and the leaching solution, represented by resistor $R_{o1}$, then through electrode 71, represented by resistor $R_{e71}$, and then through conductor 75. Assuming a balanced three-phase power source and a balanced "load" (the ore formation), then:

$$V_1 = I_eR_{e70} + I_eR_{e71} + I_oR_{o1} \tag{4}$$

but, since $$I_e = \sqrt{3}I_o$$

$$V_1 = \sqrt{3}I_oR_{e70} + \sqrt{3}I_oR_{e71} + I_oR_{o1}$$

$$V_1 = I_o(\sqrt{3}R_{e70} + \sqrt{3}R_{e71} + R_{o1})$$

$$I_o = \frac{V_1}{\sqrt{3}\ (R_{e70} + R_{e71}) + R_{o1}} \tag{5}$$

However, in actual practice the "delta" laod representing the ore bearing formation will not be balanced due to geological variations, and $I_o$ in the various legs of the "delta" system load then would not be balanced and the current, $I_o$ through $R_{o1}$, $R_{o2}$ and $R_{o3}$ would be unequal.

Figure 6:
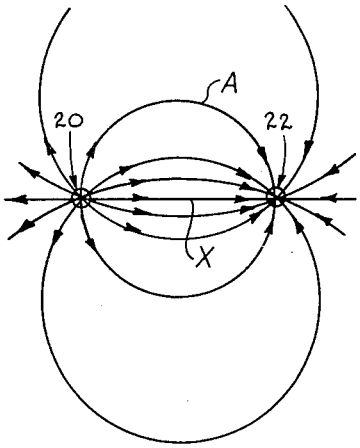
FIG. 6 is a diagrammatic view illustrating lines of current in a subsurface formation between a pair of electrode wells.

While it is contemplated that various combinations of electrodes may be utilized to treat a mineral-bearing formation, the use of a three-wall, three-phase AC arrangement may prove to be most advantageous for reasons hereafter described. Referring now to FIGS. 2, 3, 6 and 7, power distribution in the earth formation can be explained. In FIG. 6 assumed lines of current flow are illustrated for the two electrode arrangement shown in FIG. 2. For simplicity all curves are assumed to be circles. Hence the lengths of the current paths can be calculated from measurements of the radii and angular lengths of arcs. Assuming the resistance to current flow is directly proportional to the length of the current path, then the power dissipated can be calculated as:

$$P = I^2R = V^2/R \tag{6}$$

where:

P is the power dissipated
I is the current
R is the resistance
V is the voltage impressed across the resistance
Substituting L (length of the current path) for R:

$$P = V^2/L \tag{7}$$

the power at each circular arc relative to that along the direct line X between electrodes can be calculated.

Calculations show that greater than 50% of the power due to the current flow will be dissipated in a circle whose diameter is equal to the distance between the centers of the two electrodes, as can be seen in the circle shown at A in FIG. 6, thus causing a zone within circle A of great electrochemical activity reacting with the leach solution and mineral values or elements of the formation. Of course, a great amount of power will be dissipated in the formation outside of circle A, and, correspondingly, chemical reactions are also taking place in this greater zone.

Figure 7:
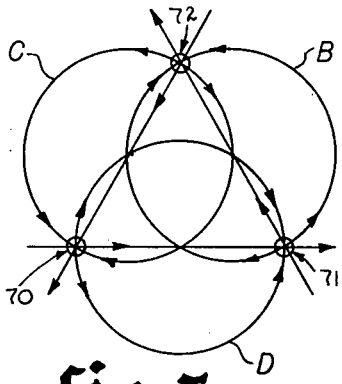
FIG. 7 is a diagrammatic view illustrating lines of current in a subsurface formation between three electrodes utilizing three-phase AC current.

Referring to FIG. 7, a triangular spacing of electrodes is shown as in FIG. 3, with the application of three-phase AC current to the three electrode wells. Here three overlapping circles B, C and D are shown as the greater than 50% power dissipation zones between each of the three wells. As can be seen by reference to FIG. 6, the three-well, three-phase arrangement treats over twice the area that can be treated by a single installation of two wells. In addition, the overlapping zones of the power distribution circles may enhance the electrochemical activity in those areas, thereby enhancing the results obtained. From comparisons of FIGS. 6 and 7, it can be seen that the area of formation treated by the electrical field and the established electrochemical zone of activity will be much larger than the area created by a two-well arrangement, and taking into account the increased spacing in the three-well test, the power distribution may have been increased by a factor of three or four or more. Accordingly, greater effects may result from multiple electrode well patterns that treat as large a zone of the ore formation as possible and practical. Increased spacing of the electrodes may enhance results; however, more power will be required to treat the formation volume as the separation of the electrodes increases.

Figure 8:
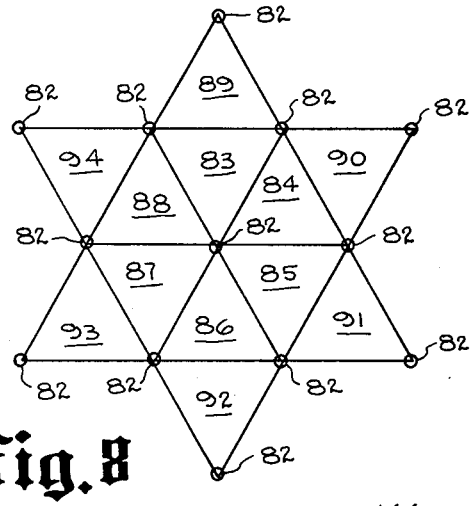
FIG. 8 schematically illustrates one manner in which the principles of the present invention can be applied to produce a series of current-producing patterns for passing electric current through an increasing area of subsurface formation.

Accordingly, referring now to FIG. 8, a three-electrode well installation could be effectively patterned as shown to progressively cover an increasingly larger area of the subsurface mineral-bearing formation. Three electrode wells 82 could be drilled and completed in a triangular pattern shown as pattern 83. This installation could be utilized for a predetermined period of time, and then by drilling another electrode well 82 a second triangular pattern 84 could be accomplished and operated for a second predetermined period of time. By drilling additional electrode wells 82, a series of triangular patterns 85–94 can be accomplished, thus distributing the electrical current over a broad area of the ore formation. Of course, any electrode wells 82 not being utilized as electrode wells in a particular installation pattern may be used as producing wells to recover the leaching solution.

Figure 9:
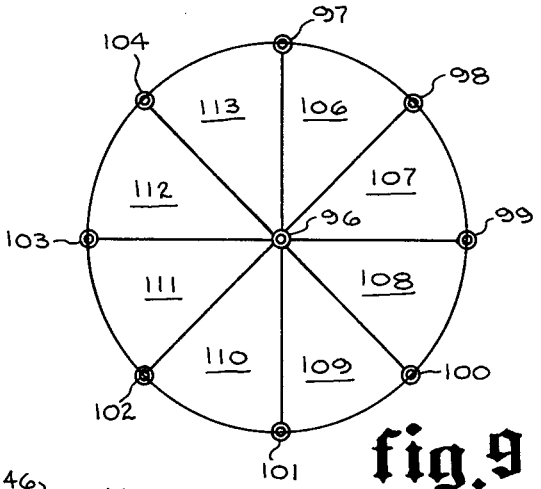
FIG. 9 schematically illustrates a second manner in which the principles of the present invention can be applied to produce a series of current-producing patterns for passing electric current through an increasing area of subsurface formation.

FIG. 9 discloses another patterning arrangement for the electrode/leach solution injection boreholes of this invention. A center well 96 is drilled 96 is drilled and equipped similar to electrode well 20 or 22 previously described in connection with FIG. 1. Then additional wells 97–104 may be drilled surrounding the center well 96. Wells 97–104 may also be completed in a similar manner to wells 20 or 22 as disclosed in FIG. 1. Electrical current can be passed between center well 96 and any other one or more of wells 97–104. Accordingly, a pattern 106 may be treated by utilizing electrode wells 96, 97 and 98. Similarly, other patterns 107–113 can be formed by utilizing other combinations of wells 96–104. When the leaching solution has permeated the treated area and pregnant leaching solution is to be withdrawn, some of the wells 97–104 may be utilized to function as both electrode wells and producing boreholes. For instance, borehole 96 may function as an electrode/-leach injection borehole while peripheral wells 97 and 98 may act as the second and third wells of a three-wall, three-phase AC pattern. Wells 97 and 98 would also function as producing wells, and the flow of leaching solution would be outwardly from well 96 through the zone 106 to producing electrode wells 97 and 98. Of course, many other combinations of wells 96 and 97–104 could be utilized.

The electrical current passing through the ore formation will produce at least the following phenomena:

1. A dramatic increase in the ion activity of the leaching solution, causing such ions to increasingly interact with the atoms of the mineral value or element to be recovered from the ore, thereby enhancing and accelerating the chemical reactions to dissolve the desired element to be separated from the ore. These interactions may result from the following atomic and ionic interactions:
   (a) a dramatic increase in the ion activity of the leaching solution, causing such ions to increasingly interact with the atoms of the mineral value or element to be recovered from the ore, thereby enhancing and accelerating the chemical reactions;
   (b) an increase in the exchange of electrons between atoms because of their proximity, thereby enhancing and accelerating the chemical reactions;
   (c) an increase in the exchange of energy between adjacent atoms due to radiations emanating from the mineral value or element in the formation, thereby enhancing and accelerating the chemical reactions;
   (d) increased activity due to the drift of a nascent atom from the leaching solution to the ore formation for combining reactivity with atoms of the mineral value or element; and
   (e) chemical electrode reactions occurring about particles of the ore formation each acting as individual "electrodes," thereby increasing chemical activity.
2. Heating the leaching solution and the ore formation, including the mineral value or element compound desired to be recovered, thereby increasing the rates of the chemical reactions;
3. In certain circumstances and depending on several factors, including the chemical composition of the leaching solution, the chemical composition of the ore deposit, the permeability and porosity of the ore formation, and others, the electrochemical interaction between the leach solution, ore formation and the impressed electrical current may generate in situ large volumes of gas that will act to pressurize the ore formation and aid in driving the leaching solution into and through the ore formation to increase solution circulation and enhance the chemical leaching process;
4. Because of local heating, steam may be generated that will provide pressurization as described in 3 above and aid in heating the ore formation and circulating the leach solution; and
5. Create chemical reactions in the leaching solution and between the leaching solution and the mineral value or element which would not occur in the absence of the electrical current.

The source of the gases generated in the formation and the reasons for its production are not fully understood at this time. But several explanations may be offered. They are:

(a) production of free hydrogen and oxygen by electrolysis of $H_2O$ contained in the leach solution on present in the ore formation;
(b) release of gas molecules dissolved in water present in the ore formation; and
(c) formation of carbon dioxide by the action of nascent oxygen reacting with carbonates and other carbonaceous materials in the ore formation or dissolved in the leaching solution.

Figure 10:
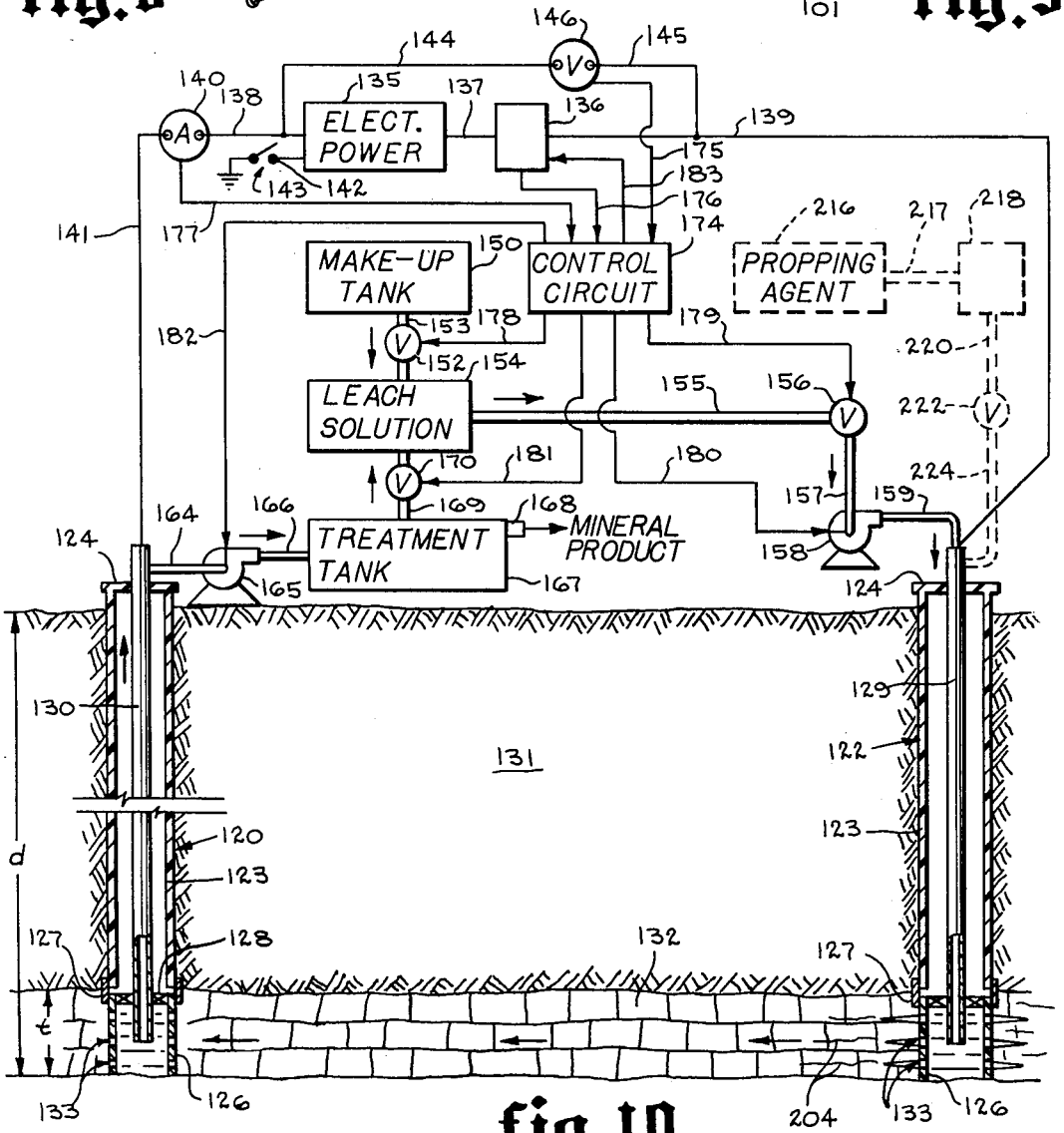
FIG. 10 is a diagrammatic view, partly in cross-section, of a subsurface mineral-bearing formation penetrated by a pair of boreholes for leaching selected soluble substances from the formation according to a second embodiment of the invention.

Referring now to FIG. 10, an embodiment for a continuous leaching operation and electrical current treatment is shown. A pair of boreholes 120 and 122 are shown penetrating overlying earth formation 131 and a selected mineral-bearing ore formation 132 to a depth "d." Boreholes 120 and 122 are conventionally cased with an insulating casing 123 down through the overlying earth formations 131 to the top of the ore formation 132. The portions of the boreholes 120 and 122 penetrating the ore formation 132 are conventionally cased with a non-corrosive metal casing 126 joined to casing 123 by means of collar 127. Casing 126 has perforations 133 into ore formation 132 for permitting communication between the ore formation and the interior of boreholes 120 and 122. Boreholes 120 and 122 are sealed by insulated wellheads 124.

An electrode 130, conveniently a string of conventional tubing, it disposed in borehole 120 and an identical electrode 129 is disposed in borehole 122. Electrodes 129 and 130 are centralized in the boreholes by means of a conventional packer 128. Electrode 130 of borehole 120 is connected by means of conductor 141, ammeter 140 and conductor 138 to a source of electrical power 135. The power source 135 is connected to a power regulating means and/or timing device 136 by means of conductor 137. Electrode 129 is connected to regulator 136 by conductor 139. A volt meter 146 is connected across the power source 135 and regulator 136 by conductors 144 and 145.

A leach solution make-up tank 150 is provide for mixing the selected leach solution which is admitted to a leach solution storage tank 154 through piping 153 and valve 152. Leach solution is pumped through piping 155, valve 156, piping 157, pump 158 and piping 159 into tubing string 129 for injection into the ore formation 132. Tubing string 130 communicates with a conventional borehole pump 165 through piping 164. The output of pump 165 is directed through piping 166 to a treatment tank 167 for separation of the selected mineral value or element which is discharged via outlet 168 for further handling. The treated leach solution may be recycled and reused in many cases and could be discharged from treatment tank 167 through piping 169 and valve 170 back into the leach solution storage tank 154 for reuse.

A control circuit 174 may also be provided for automatically controlling the continuous operation of the leaching process as will hereinafter be further described. Control circuit 174 receives input signals from the power regulator 136 via conductor 176, from the volt meter 146 via conductor 175, and from the ammeter 140 via conductor 177. The control circuit 174 controls various functions of the leaching process by sending control signals to the power regulator 136 via conductor 183, make-up tank discharge valve 152 via conductor 178, leach solution discharge valve 156 via conductor 179, valve 170 via conductor 181, pump 158 via conductor 180, and pump 165 via conductor 182.

In operation, leach solution is mixed in make-up tank 150 and supplied to leach solution storage tank 154 through piping 153 and valve 152. Leach solution is then pumped into borehole 122 through tubing string 129 by pump 158 receiving leach solution from tank 154 through piping 155 and 157 and valve 156. Initially, leach solution could be supplied to borehole 120, electrical power could be supplied from electrical power source 135 to ore formation 132 through electrodes 129 and 130, and the initial operation of the leaching process augmented by electrical power would proceed as hereinabove described in relation to FIG. 1, where the electrical return is through the earth by means of switch 143 and conductor 142. Once the leach solution and electrical current have established a contiguous zone between boreholes 120 and 122 through ore formation 132, leach injection through borehole 120 would be stopped and the tubing string 130 would be connected to treatment tank 167 by means of pump 165 and piping 164 and 166 as shown in FIG. 10, and switch 143 would be opened to isolate the current flow through formation 132.

The pregnant leach solution, containing the soluble elements of the ore formation desired to be removed, would be withdrawn through tubing string 130 by pump 165 and pumped into the treatment tank 167 through piping 166 for conventional treatment to separate or refine out the desired mineral value or element. The recovered mineral value or element would be discharged from tank 167 through a discharge pipe 168 for further handling. The reusable leach solution would then be discharged from tank 167 through valve 170 and piping 169 to the leach solution storage tank 154 for reuse. The quantity of leach solution in the ore formation can be controlled in response to changes in the current in the system, as monitored by ammeter 140, or by monitoring temperature, pressure or flow characteristics. The quantity of leaching solution injected into the formation can be regulated by means of valve 156 and pump 158.

The continuous flow operation above described can be automated and controlled by a control means such as the control circuit 174. As hereinabove described, the voltage, amperage and power regulation information can be supplied from volt meter 146, ammeter 140 and regulator 136 via conductors 175, 177 and 176, respectively. The control circuit in turn controls the flow of mixed leach solution from tank 150 through tank 154 and pump 158 into borehole 122 by controlling the operation of valves 152 and 156 and pumps 158. In addition, control circuit 174 controls the withdrawal of pregnant leach solution from ore formation 132 by controlling pump 165. Valve 170 is controlled by control circuit 174 to regulate flow of reusable leach solution from the treatment tank 167 to the leach solution tank 154. Control circuit 174 may be any electrical or electro-mechanical control means and lends itself to a fully computerized system for controlling the leaching and recovery process, thereby reducing labor costs significantly.

In the production of petroleum from oil-bearing formations of low permeability, it is often advantageous to hydrofracture the formation to obtain a commercially adequate oil flow into the producing borehole. In principle this process consists of applying sufficient hydrostatic pressure to the oil-bearing formation to lift the overburden and rupture the formation rock. Crude oil is often used as the hydraulic fracturing fluid. After the well begins to produce, the injected crude oil is recovered. To maintain the induced permeability due to fracturing, it is also customary to introduce finely divided grains of sand or other propping agents with the injected oil. When the pressure is reduced, these injected sand grains or propping agents serve to keep the layers of fractured rock apart sufficiently to maintain the openings or fractures through which the oil or gas can readily flow to the borehole.

The principle of hydrofracturing can be applied to in situ leach mining for augmenting the permeability of ore deposits of low permeability in order to enhance the circulation of the electrolytic leaching solution. To accomplish this, the apparatus shown in dotted lines in FIG. 10 may be utilized. A source 216 of a suitable selected propping agent, such as sand, in the form of a slurry, is provided for supplying the propping agent to a mixing chamber or injector 218 through interconnecting piping 217. The output of the injector 218 is interconnected through piping sections 220 and 224 and valve 222 to tubing string 129 for mixing with the leach solution from tank 154. The hydrofracturing of formation 132 is accomplished by injecting leaching solution into formation 132 at high hydrostatic pressure produced by the head of leaching solution in tubing 129 augmented by pressure from pump 158. The propping agent slurry/leaching solution mixture flows out of the lower end of tubing 129 and is injected into formation 132 through perforations 133 to produce fractures 204 in formation 132. Similarly, the formation 132 can be fractured around borehole 120 by utilizing the same equipment and provide contiguous liquid conducting fractures between the two boreholes. Once fluid flow and electrical conduction have been established through hydrofracturing adjacent boreholes, the embodiment hereinabove described in relation to FIG. 8 can be utilized to inject leaching solution and recover mineral values.

The acidizing of oil wells has long been an accepted completion technique in carbonate reservoirs. In fact, it is doubtful if many presently producing carbonate reservoirs would have been developed if acidizing were not available. In this process concentrated solutions of hydrochloric acid (HCl) are pumped down the borehole and out into selected strata. Packers are used to delimit the depths at which acidizing takes place.

After the carbonate rock has reacted with the acid, forming $CO_2$ and $CaCl_2$ in the formation, these dissolved substances are pumped or flow to the surface through the borehole followed by an augmented amount of gaseous or liquid hydrocarbon.

In some strata the effectiveness of acidizing is increased by hydrofracturing the selected strata before or during the acidizing process. The fracturing of the limestone rock provided additional access for the acid and increases the interfacial area between the acid and the rock.

However, these procedures are expensive and time-consuming. The use of electrical energy to agument the chemical effects of acidizing and the mechanical effects of hydrofracturing provides a simple, relatively inexpensive means of improving the effectiveness of acidizing and decreasing the time required for carrying out this process in oil field operations and in the leaching of mineral deposits.

Electrical current (DC, AC, pulsed DC, or a mixture of DC and AC) is supplied to the formation using an acid solution as a conducting electrolyte. To restrict the electrical energy to the selected strata being acidized, insulated conductors, tubing and/or insulated casings are used as hereinbefore described. This application of electrical energy augmentation can be utilized for treatment of a single borehole, two adjacent boreholes or a multiplicity of boreholes in a manner similar to those already described. In the present case, instead of salt water or chemical leaching solution injection through the tubular electrode, selective acid solutions would be injected into the acid-reactive formation, such as limestone. Simultaneously, electrical energy would be used to enhance the chemical reaction through the following effects:

1. Increase in formation temperature by joule heating ($I^2R$);
2. Electrochemical interactions at the acid-rock interface in which nascent atoms of H, O, Cl, etc. are generated by electrolysis;
3. Chemical reactions produced by the gases released in electrolysis, including $H_2$, $O_2$, $CO_2$, $Cl_2$;
4. Greater penetration of the formations by the injected acid solutions resulting from the buildup of gas pressure.

Among the important advantages of this electrical augmentation are:

(a) it allows lower concentrations of acid to be used, thereby reducing the corrosive effect of the acid on metal parts;

(b) it greatly reduces the total amount of acid required for an equivalent acidizing treatment;

(c) it allows remote control of the acidizing effect through selective variations in the applied electrical energy; and (d) in the single as well as the multiple hole applications, it provides a means of measuring the degree of permeability and porosity augmentation that has occurred during the acidizing in terms of the change in electric current for a given applied voltage.

Figure 11:
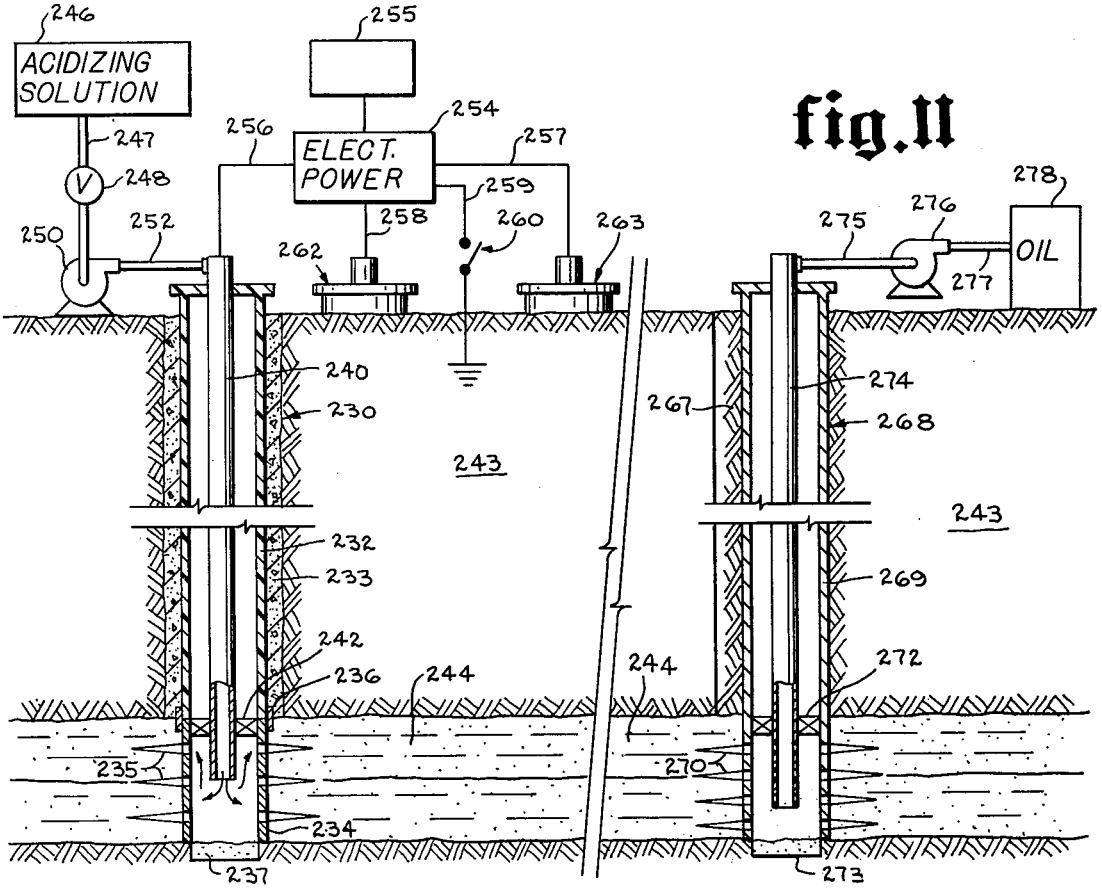
FIG. 11 is a diagrammatic view, partly in cross-section, of a subsurface mineral-bearing formation penetrated by a plurality of boreholes for injecting a selected acidizing solution into an oil-producing formation for increasing the permeability of the formation by electrochemical means to enhance oil recovery.

The acidizing process and apparatus generally described above is shown in FIG. 11. A plurality of electrode borehole installations 230, 262 and 263 are drilled into the formation 244 through the overlying strata 243. Electrode borehole installations 262 and 263 are identical to borehole installation 230 and, accordingly, only the details of borehole 230 will be described. Insulated casing 232 is set in cement 233 in a conventional manner through overburden 243 and down to the top of formation 244. A steel casing section 234 is set in the formation 244 on a plug 237 and attached to casing 232 by means of a collar 236. A tubing string 240, acting as a conduit for the acidizing solution and as an electrode, is coaxially disposed in casing 232 and centralized by a packer 242 which also functions to seal off the formation to prevent escape of the acid solution. Perforations 235 provide communication between the formation 244 and the interior of steel casing section 234.

A tank of acidizing solution 246 is connected to a pump 250 by means of a valve 248 and piping 247. The discharge of pump 250 is connected through pipe 252 with the tubing string/electrode 240 in order to introduce the acidizing solution into the formation 244. A source of electrical power 254 applies electrical power to the electrode boreholes 230, 262 and 263 through conductors 256, 258 and 257, respectively. The power source can also be connected to ground through conductor 259 and switch 260. A conventional power regulating means 255 is provided to regulate the power source 254.

Spaced from electrode borehole 230 is a producing borehole 268 having conventional casing 269 set in cement 267 and penetrating formation 244. A plug 273 is set in the bottom of the borehole. Perforations 270 are provided to establish communication between the borehole and the formation 244. A tubing string 274 or other borehole means for recovering the crude oil or other mineral values and transporting it to the surface is disposed in casing 269 and centralized by a packer 272. A conventional pump 276 is connected to tubing string 275 for pumping the oil or mineral value solutions into a storage tank 278 through piping 277.

In operation, the acidizing solution from tank 246 is pumped down into the borehole 230 by pump 250 through valve 248, piping 247 and 252 and tubing string 240 and into contact with the formation 244. Electrical power is applied across formation 244 by means of power source 254 applying electrical power through conductors 256, 258 and 257 to electrode boreholes 238, 262 and 263 respectively. The passage of the electrical current across the formation acid interface produces accelerated chemical reactions as hereinabove described, thus shortening the time necessary to acidize a given area or zone of the formation. The acidizing process renders the formation more permeable and porous, thereby enhancing the flow of fluids in the formation.

Borehole 268 may have been similarly treated as above described and then used as a producing borehole for pumping fluids from formation 244 through tubing 274 to a storage tank 278. Accordingly, all of the above described effects and advantages would come into play in the system described above for FIG. 11.

Another form of solution mining utilizing a chemical leaching solution is employed in leaching mineral values or elements from mine tailings on the surface. Such tailings, though not commercially valuable as ore material, often contain valuable minerals and/or elements that can be economically extracted on a commercial basis. Such leaching of mine tailings has been utilized to recover copper from copper ore tailings.

Figure 12:
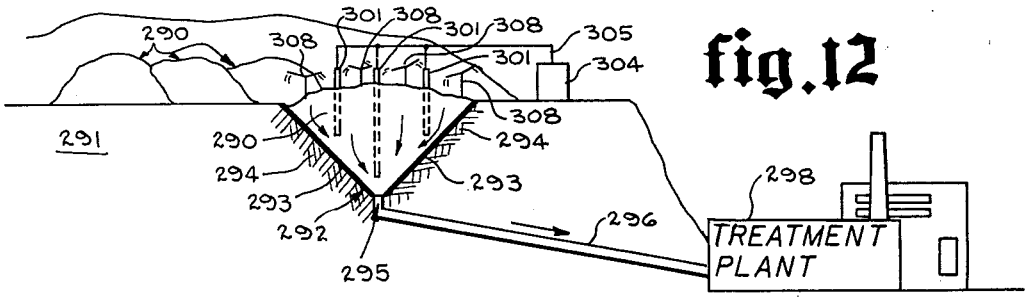
FIG. 12 is a diagrammatic view of one embodiment of the present invention for surface leaching of mine tailings for recovery of selected substances from the tailings according to this invention.

FIG. 12 illustrates diagrammatically one embodiment of the present invention for leaching tailings. Piles of tailings 290 are discarded in the operation of mine 291. A conical cavity 292, man-made or natural, is provided and is covered with an impervious insulating lining or covering 293 to prevent electrical leakage and loss of leaching solution. Alternatively, the cavity could have an impervious natural rock base 294 to provide the same electrical insulation and fluid sealing characteristics as lining 293. Tailings 290 are heaped into cavity 292, and electrodes, such as electrodes 301 are disposed in the tailing pile. Electrical power is provided by power source 304 through conductor 305 to the plurality of electrodes 301. Leaching solution is applied to the tailings by means of sprinklers 308 distributed over the surface of the pile of tailings 290 and connected to a latch solution source and necessary piping (not shown). The sprinklers 308 distribute a predetermined quantity of leach solution over the tailings pile 290, and the leach solution percolates down through the porous tailings pile, leaching out the selected mineral value or element and carrying the mineral value or element in solution, in accordance with the hereinabove described chemical reactions enhanced by the presence of the electrical current. The pregnant leach solution drains through drain 295 and piping 296 to a treatment plant 298 for recovery of the selected mineral value or element from the leaching solution according to conventional separation and refining techniques and processes. The recovered leach solution may be recirculated in the manner hereinbefore described.

Figure 14:
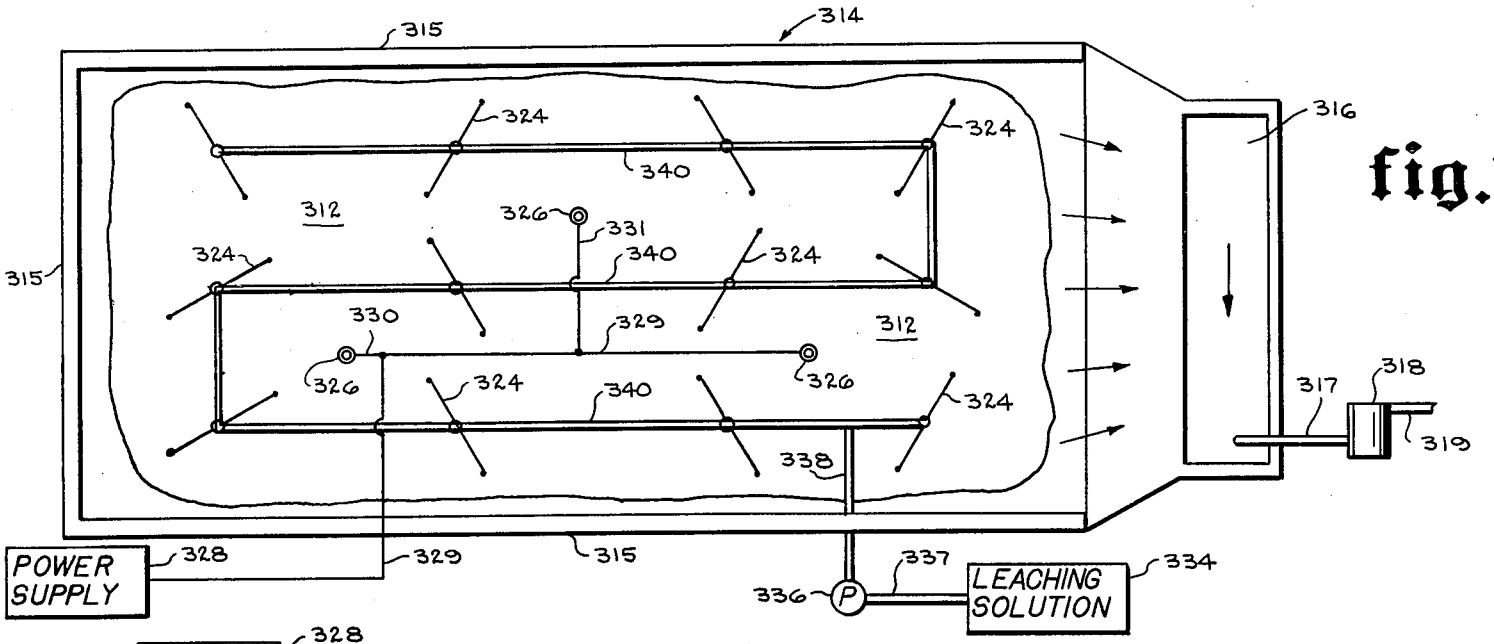
FIG. 14 is a top view of the second embodiment of the surface leaching of mine tailings as shown in FIG. 11.
Figure 13:
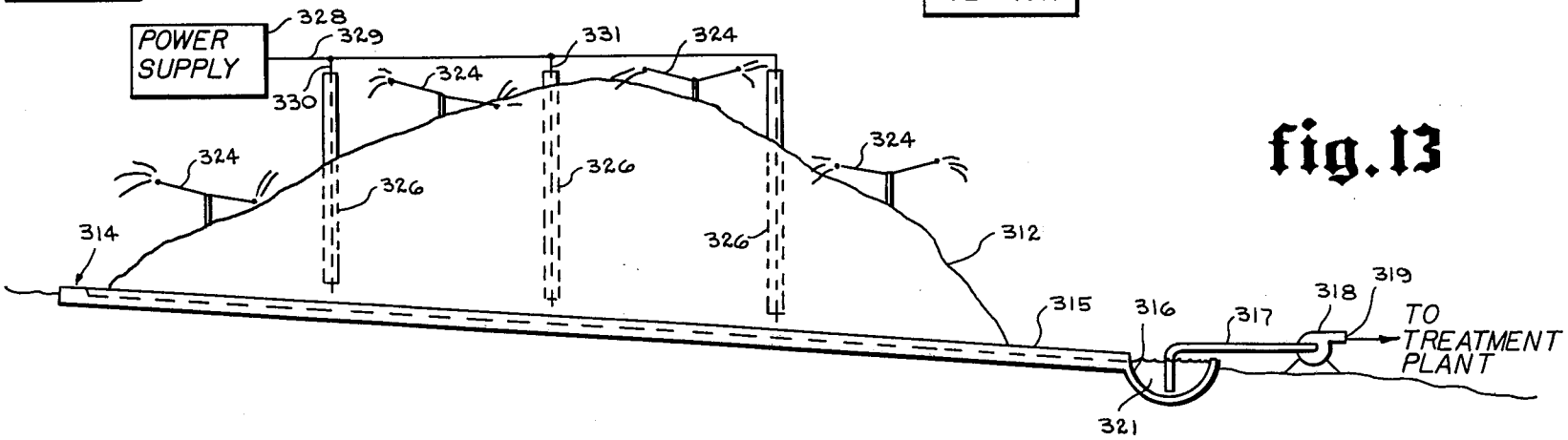
FIG. 13 is an elevational view of a second embodiment for the surface leaching of mine tailings according to this invention.

Referring now to FIGS. 13 and 14, another embodiment of the invention is disclosed. An impervious pad 314 made of concrete or other material and lined with an impervious material to prevent the loss of leaching solution and to prevent electrical current leakage into the ground is shown. Pad 314 slopes toward its open end to allow the leach solution to drain to ward the sump or collecting tank 316. Pad 314 has shallow walls 315 on three sides to contain the leaching solution. A pile 312 of tailings is placed on pad 314 and leaching solution from tank 334 is pumped through piping 337, 338 and 340 to a plurality of spaced sprinklers 324 for evenly distributing leaching solution over the surface of tailings pile 312. A plurality of electrodes 326 are disposed in the tailings pile 312 and are connected to a source of electrical power 328 by conductors 329, 330 and 331.

A pump 318 pumps the pregnant leaching solution from sump 316 through intake pipe 317 and delivers it through discharge pipe 319 to conventional treatment facilities to separate and/or refine the mineral value or element. In operation, the sprinkled leach solution soaks into the tailings pile 312 and percolates through the loose tailings particles, leaching out the selected mineral value or element in the presence of the electric current passing between the electrodes, which enhances the chemical reactions as hereinbefore described.

Three electrodes 326 are shown, but other numbers of electrodes may be utilized to provide the necessary electric current to treat the tailings-leach solution mix. Three-phase AC power is preferred; however, single-phase AC, DC, pulsed DC, or an AC voltage impressed on a DC level may be employed.

Figure 16:
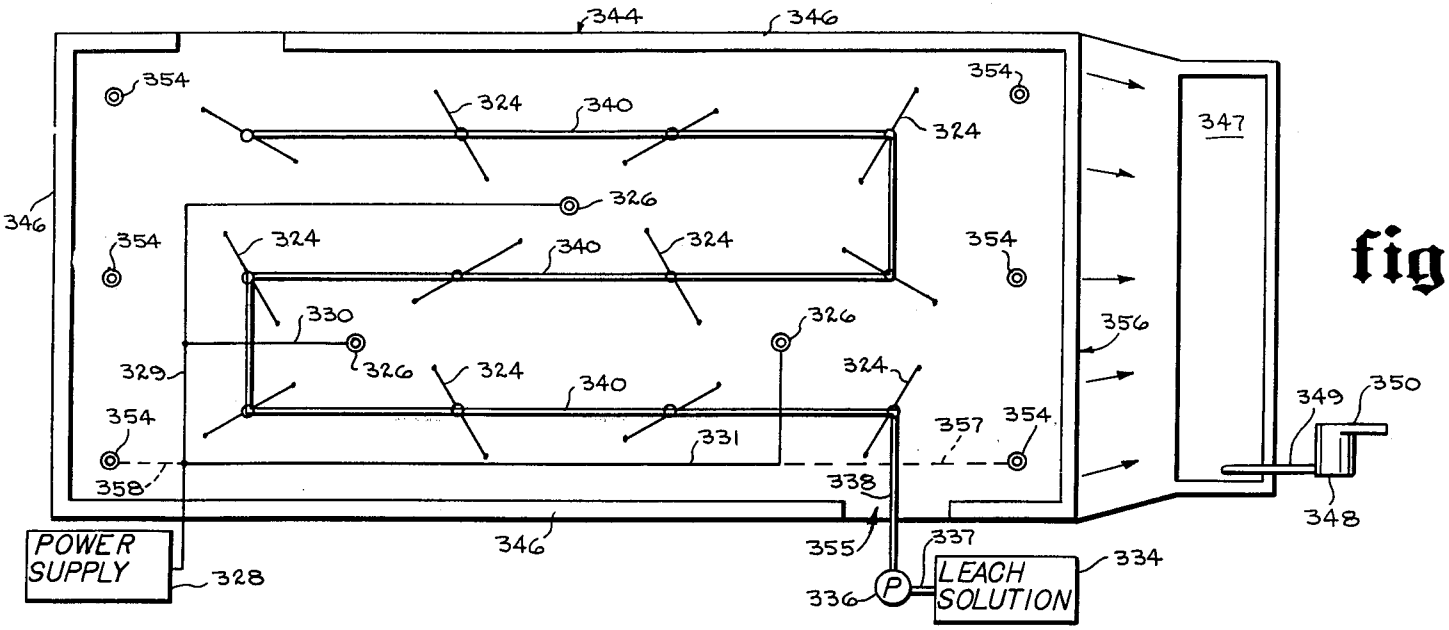
FIG. 16 is a top view of the third embodiment for the surface leaching of mine tailings as shown in FIG. 13.
Figure 15:
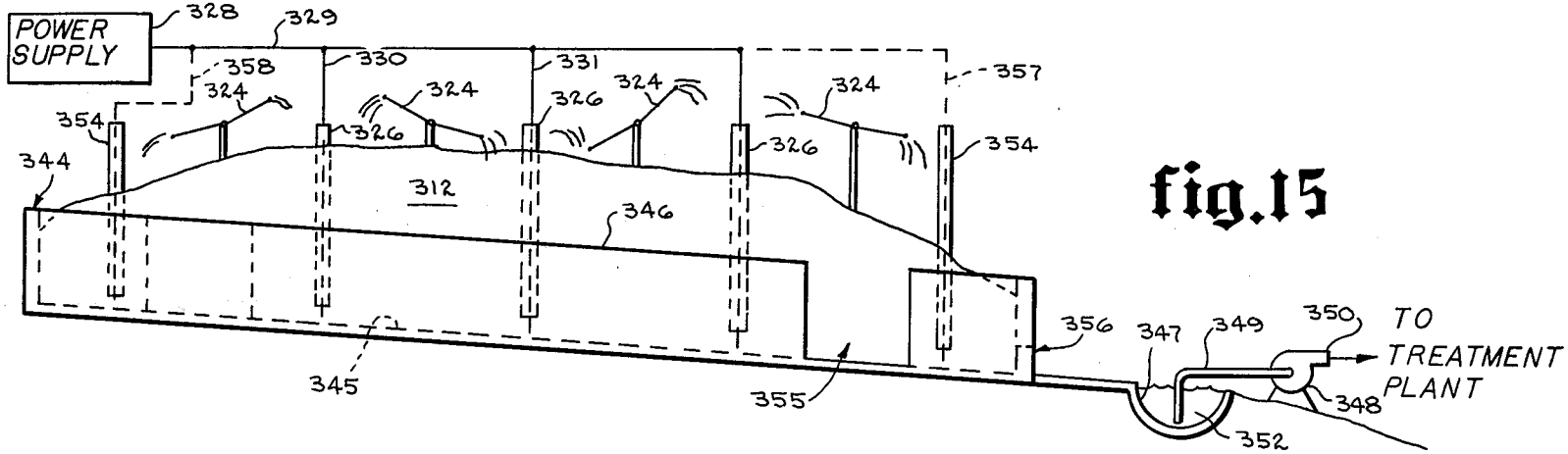
FIG. 15 is an elevational view of a third embodiment for the surface leaching of mine tailings according to this invention.

Another embodiment for the surface leaching of tailings is shown in FIGS. 15 and 16. A tailings enclosure or pad 344 constructed of concrete or another impervious material or lined with an impervious material is provided for accepting a quantity of tailings 312 for the leaching process. Enclosure 344 has upstanding walls 346 for retaining the tailings and containing the leach solution. Openings 355 are provided in walls 346 to facilitate removal of the tailings when the leaching process is completed. As in the previous embodiment, the floor 345 of enclosure 344 slants toward the open end and the sump 347 to allow the leaching solution to drain by gravitational force int the sump or collecting tank 347.

Leaching solution from a tank 334 is pumped by pump 336 through piping 337, 338 and 340 to a plurality of spaced sprinklers 324, as hereinbefore described for the previous embodiment. Electrodes 326 and a source of electric power 328, interconnected by conductors 329, 330 and 331, are provided as hereinabove described in connection with the previous embodiment. Additional electrodes for obtaining greater electrical current coverage are provided in electrodes 354 which may be interconnected by conductors 357 and 358.

An aperture or gate 356 is provided in the downhill end of the enclosure 344 to allow unrestricted drainage of the leaching solution along floor 345 into sump 347. The collected pregnant leaching solution 352 is pumped by pump 348 from the sump 347 through pipe 349 and delivered through pipe 350 to a conventional chemical treatment plant for separation and/or refining of the extracted mineral value or element.

While the above embodiments are described in connection with leaching mine tailings, other ores or crushed rock material may be treated to extract valuable minerals or metals. In addition, under certain circumstances, crushed ores containing insoluble valuable mineral compounds or elements, for instance diamonds, could be treated on the surface like mine tailings using the embodiments hereinabove described, but utilizing a leaching solution selected to leach out the gangue material and leave the desired mineral value or element. In other applications, such as electrically leaching bauxite ore, the selected leaching solution would be able to dissolve soluble ferric oxides and leave behind the more valuable $Al_2O(OH)_4$ and or $Al_2O_3+2H_2O$ for the recovery of aluminum metal. However, the iron or ferrous content of the pregnant leach solution could also be recovered in commercial quantities for a double recovery of a mineral value or element.

The above described embodiments and processes relating to the electrical enhancement of the chemical reactions of the leaching process have been described in relation to in situ leaching of subsurface formations or the surface leaching of ore residues, such as mine tailings. However, finely granulated or powdered materials such as casting sand, shale, tailings or ores may be treated in a continuous process for leaching selected mineral values or elements or removing unwanted residues or coatings from such materials. One example is the cleaning of casting sand. A number of industries use sand as the primary ingredient in the manufacutre of molded components for machinery. The sand is mixed with a very finely ground coal and bentonite, a water-absorbing shale, and when slightly moistened is capable of being formed into and maintaining a shape into which the molten metal can be poured and formed. New casting sand has slick surfaces which require the use of a selected coating material to insure adhesion of the bentonite and coal.

When the mold is used, the sand is exposed and subjected to intense heat with the result that the coal is "coked" onto the sand grains, and other foreign materials such as metal particles are deposited in the sand mixture. Casting sand has limited re-use capability and must therefore be discarded as waste when coated with excessive "coke." Conventional sand cleaning methods involve means for physically "beating" the sand grains to knock off the "coke," but this is not always successful since not all of the "coke" can be removed using this process.

Utilizing the electrical current to enhance chemical reactions, the sand can be completely cleaned and reclaimed in a matter of minutes. The "dirty" sand is placed in a suitable vessel insulated from ground. The sand is mixed with an acidic electrolyte, such as a dilute solution of hydrofluoric acid in a saline solution. The acid solution and the "dirty" sand are mixed to form a slurry in the vessel.

A plurality of spaced electrodes are placed in the vessel and immersed in the sand-acid solution slurry. When an AC or pulsed DC current of preselected magnitude is passed through the sand-acid solution slurry, the "coke," bentonite and other materials adhering to the sand grains are almost instantly removed from the sand grains, leaving them clean and in virtually their original pristine state, except that the original slick surfaces are now slightly etched. The "coke" is not dissolved but is released to the solution in finely granulated form. By using appropriate cyclones, centrifuges, desanding cones, etc., the sand can be recovered and the "coke" removed from the solution in order that the acid can be reused. It is not now known exactly what action is taking place in such cleaning of casting sand. Several theories could explain the cleaning of the "coked" materials from the sand grains. They are:

1. The electrical current breaks chemical bonds (covalent, electrostatic and Van de Waal) between each sand grain and the bentonite coating, permitting the bentonite to slough off and be released and thereby carrying the "coke" grains along. The acid solution then etches the sand grain surface to make it more receptive to a new bentonite coating.
2. The electrical current enhances and accelerates the chemical reaction of the acid in dissolving the bentonite film from the sand grain, thereby releasing the "coked" particles;
3. The electrical current breaks chemical bonds between the insoluble "coke" and each sand grain, releasing the "coke" and permitting the electrical current to enhance and accelerate the chemical reaction of the acid in dissolving the bentonite film from the sand grains.

Figure 17:
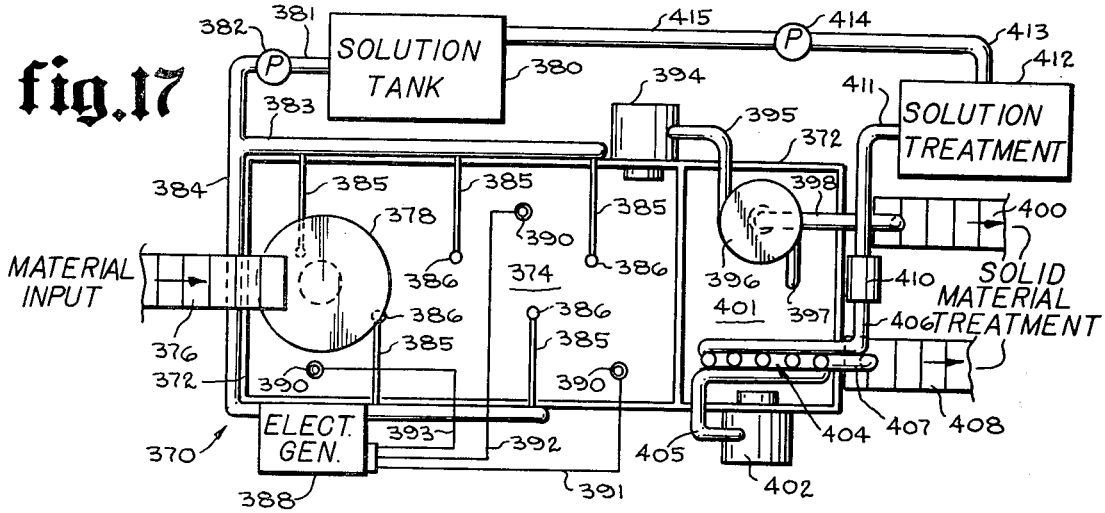
FIG. 17 is a plan view of apparatus for treating finely granulated materials according to one embodiment of the present invention.

Referring to FIG. 17, apparatus for accomplishing the sand cleaning process is shown. A sand cleaning apparatus or means 370 is shown and has a suitable vessel or tank 372 having upright walls for forming a vessel for containing the sand-acid solution slurry. Vessel 372 has a dividing wall 373 for dividing the vessel into two compartments for purposes to be hereinafter further explained. Dirty casting sand is delivered to the cleaning apparatus 370 on a conveyor 376 which dumps the sand into a hopper 378 which discharges into tank 372. A "leaching" solution, such as an acid base electrolyte, is delivered from tank 380 by pump 382 through piping 381, 383 and 384 to pipes extending into the sand mixture in the larger tank 372 portion and directed into the sand in the tank through jets or nozzles 386 to saturate the sand and form a slurry 374 which is kept agitated and circulating by the spray action of the acid solution being sprayed into the slurry. A plurality of electrodes 390 are disposed in the tank 372 for contacting the slurry and passing an electrical current therethrough upon application of electrical power from generator 388 and applied to the electrodes 390 by conductors 391, 392 and 393. The sand-acid slurry 374 reacting with the electrical current passing through the slurry cleans the sand grains as hereinabove described.

A pump 394, communicating with tank 372 pumps the slurry 374 from the tank and delivers the slurry to the input of a cyclone or centrifuge 396 which separates the acid solution and fine "coked" particles from the cleaned sand, and discharges the acid solution and the "coked" particles into the smaller portion of tank 372 as a mixture 401 through discharge pipe 397. The separated cleaned sand is discharged from the cyclone 396 through pipe 398 onto a conveyor 400 for delivering the sand to a suitable collection point for further processing, such as rinsing and drying.

A pump 402 withdraws the mixture 401 of acid solution and "coked" particles from tank 372 and delivers the mixture through pipe 405 to a bank of cyclones or "desanding cones" 404 for removing the "coked" particles which are discharged through pipe 407 to be deposited on conveyor 408 for delivery to a suitable collection point for further treatment or disposal. The separated acid solution and extremely small particles are discharged through piping 406 to a filter 410 for removing all or virtually all particles therefrom; the filtered acid solution is then forwarded through pipe 411 from filter 410 to a solution treatment tank 412 where the acid solution may be further cleaned and prepared for reuse by utilizing conventional chemical processes. The "recycled" solution is then delivered via piping 413 and 415 by pump 414 to the solution holding tank 380 for redistribution to the tank 372.

While the above has been described in connection with the cleaning of casting sand, the same apparatus and basic process could be used to clean other finely granulated or powdered materials such as certain catalytic agents, and also for leaching ores commingled with mine tailings and the like. The continuous circulating process above described can thereby handle large volumes of materials on a continuous processing cycle.

Figure 18:
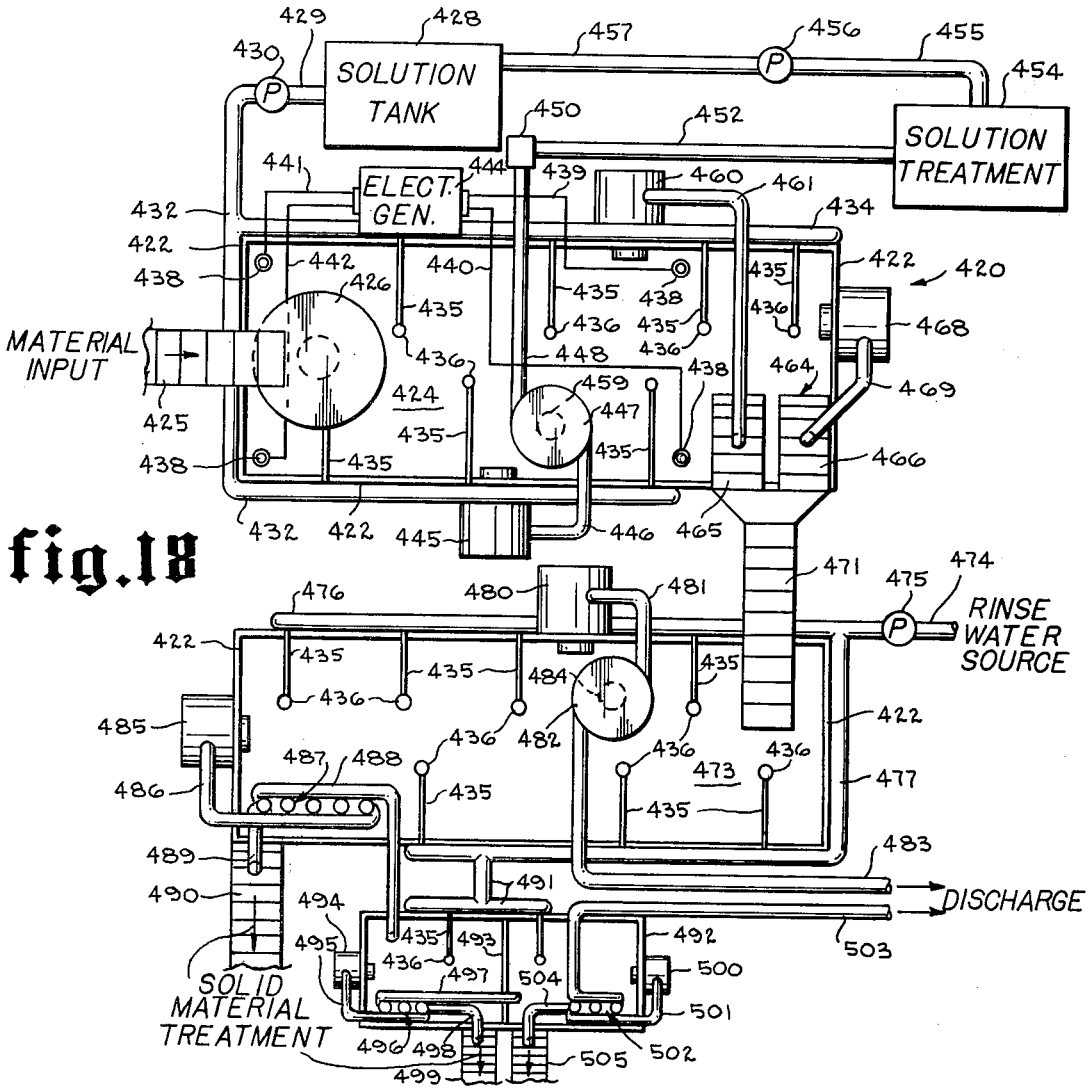
FIG. 18 is a plan view of apparatus for treating finely granulated materials according to a second embodiment of the present invention.

Another system 420 for cleaning casting sand, or for reactivating catalyst materials or other powdered or granulated materials, is shown in FIG. 18. A walled vessel or tank 422 is provided with insulation from the earth upon which it stands, and an acid solution from tank 428 is pumped by a pump 430 through piping 429, 432 and 434 to pipes 435 projecting into the interior of tank 422. The granulated material to be treated or cleaned is delivered by conveyor 425 from a material source (not shown) to a hopper 426 which discharges the material into tank 422. The acid solution delivered from tank 428 to interior pipes 435, is sprayed into the material in the tank 422 through jets or nozzles 436 to saturate the material and create a material-acid solution slurry 424. A plurality of electrodes 438 are provided for receiving electrical power from generator 444 by way of conductors 439, 440, 441 and 442, for passing electrical currents through the material-acid solution slurry 424 for effecting the electro-chemical reactions hereinabove described for previous embodiments of the invention.

Pump 445 withdraws the material-acid solution slurry 424 from tank 422 and delivers the slurry 424 as an input to a cyclone or centrifuge 447 through piping 446. The leached or cleaned material is discharged from cyclone 447 through discharge port 459 back into tank 422 for further treatment. The acid solution carrying solid particles is discharged through pipe 448 to a filter 450 for removing most of the particles, and the solution is then delivered through pipe 452 to a treatment tank 454 for conventional chemical treatment of the solution to prepare it for reuse. The recycled solution is delivered through pipes 455 and 457 by pump 456 to the leaching solution tank 428 for return to the tank 422.

Pumps 460 and 468 withdraw slurry 424 from tank 422 for delivery through pipes 461 and 469, respectively, to units 465 and 466 of a dual screen separator 464, where particles of a predetermined size or larger are separated and discharged to a conveyor 471 for delivery to a rinsing tank or vat 472. Non-filtered particles of less than such predetermined minimum size, and the solution, are returned to the tank 422 for mixing with the slurry 424.

Tank 472 is a walled tank or vessel having supplied therein a continuous flow of rinse water supplied by pump 475 from a source (not shown) through pipes 476 and 477 to a plurality of interior sprinkler or jet pipes 435 for discharge through nozzles 436 to circulate the slurry 473 in the tank 472. The material particles delivered by conveyor 471 are mixed with the rinse water by the action of the discharge from nozzles 436 to form a material-water slurry 473 that is circulated and agitated by the action of the nozzles 436. Pump 480 withdraws the material-water slurry 473 and delivers it to a cyclone or centrifuge 482 through pipe 481. The heavy material particles in the slurry 473 are discharged from cyclone 482 through discharge port 484 back into tank 472. Any lighter particles, together with the rinse water, will be discharged from cyclone 482 through pipe 483. Pump 485 delivers slurry 473 to a bank of cyclones or "desanding cones" 487 by way of pipe 486. The liquid containing lighter particles is discharged from the cyclones 487 through discharge pipe 488 to a third tank 492. The heavier particles removed by the cyclones 487 are discharged through pipe 489 to a conveyor 490 for delivery to a dump or to other equipment (not shown) for further treatment or recovery.

Vessel or tank 492 is divided into two chambers by a partition wall 493. As above described, the rinse water and particles from cyclones 487 associated with rinsing tank 472 are discharged into one chamber of tank 492 through pipe 488. Water for purposes of agitating and circulating the mixture of rinse water and particles is provided to tank 492 by piping 491, interconnected to pipe 477, hereinabove described, through discharge pipes 435 and nozzles 436 in each chamber of tank 492. Pump 494 withdraws the mixture of rinse water and particles from one compartment of tank 492 and delivers the mixture through pipe 495 to the input of a bank of cyclones or "desanding cones" 496. The solid material removed by cyclones 496 is discharged through pipe 498 to a conveyor 499 or other delivery means for removal and/or treatment. The rinse water and particles not removed by cyclone bank 496 is discharged into the second compartment of tank 492 through pipe 497. Pump 500 withdraws the mixture of rinse water and remaining particles from the second compartment of tank 492 for delivery to a bank of cyclones or "desanding cones" 502 through pipe 501 for further removal of particles from the rinse water. Fine material particles removed by cyclones 502 are discharged through pipe 504 for delivery to a conveyor 505 or other removal means for discharge, dumping or further treatment. The removed water and any remaining particles are discharged through pipe 503.

Numerous variations and modifications may obviously be made in the structures and methods herein described without departing from the present invention. Accordingly, it should be clearly understood that the forms of the invention herein described and shown in the figures of the accompanying drawings are illustrative only and are not intended to limit the scope of the invention.

What is claimed is:

1. A method of electrolytic in-situ leach mining of a selected element from an earth formation, comprising establishing at least two spaced apart boreholes extending into a subsurface earth formation containing said selected element, injecting a quantity of an electrically conductive leach solution, containing a selected reaction agent for chemically reacting with said selected element, into each borehole for establishing an electrical coupling between said boreholes, disposing a separate electrical conductor in each of said boreholes and into electrical contact with said electrolytic solution, insulating both of said conductors from substantially all earth materials adjacent said boreholes and lying above said subsurface earth formation to establish an electrical path composed of said insulated conductors and said formation materials and said electrolytic leach solution extending therebetween, establishing an AC flow of electrical current in said electrical path, electrochemically accelerating the rate of the chemical reaction between said selected element and said selected reaction agent in accordance with the formula:

$$K = Ae^{-(E/RT)}$$

where:

E is the activation energy of the reaction

R is the gas constant

A is the frequency factor, and

T is temperature by increasing the temperature T in the formation and increasing the frequency of collision of the reacting atoms, radicals or ions A, and by decreasing the activation energy of the reaction E, and withdrawing said leach solution carrying said chemically reacted first element from said formation.

2. The method described in claim 1, wherein said current flow between said electrodes is a flow of single-phase AC current.

3. The method as described in claim 1, further including the steps of establishing a third borehole extending into said formation and spaced generally triangularly from said at least two spaced apart boreholes, disposing a third electrical conductor in said third borehole and into electrical contact with said electrolyte leach solution, in said formation, insulating said third conductor from substantially all earth materials adjacent said third borehole and lying above said formation, and interconnecting a three-phase AC current to said conductors with each conductor receiving a different phase thereof.

4. A method of removing a first chemically reactive element from a generally insoluble gangue material in a comminuted form as mine tailings, comprising the steps of introducing a selected electrically conductive leaching solution containing a second chemically reactive element into contact with a quantity of said comminuted gangue materials, insulating said comminuted gangue materials and said leach solution from direct ground contact, establishing an AC flow of electrical current in said leaching solution in contact with said comminuted gangue materials, electrochemically accelerating the rate of the chemical reaction between said selected element and said selected reaction agent in accordance with the formula:

$$K = Ae^{-(E/RT)}$$

where:

E is the activation energy of the reaction

R is the gas constant

A is the frequency factor, and

T is temperature by increasing the temperature T in said materials and increasing the frequency of collision of the reacting atoms, radicals or ions A, and by decreasing the activation energy of the reaction E, and withdrawing said leach solution carrying said chemically reacted first element from said materials.

5. The method described in claim 4, wherein said current flow is a flow of single-phase AC current.

6. The method described in claim 4, wherein said current flow is a flow of three-phase AC current.

* * * * *